US005318411A

United States Patent [19]

Heinrichs et al.

[11] Patent Number: 5,318,411

[45] Date of Patent: Jun. 7, 1994

[54] COMPRESSOR WITH INTEGRAL FILTER

[75] Inventors: Anton D. Heinrichs, Canastota, N.Y.; Barry A. Cavanaugh, East Longmeadow, Mass.

[73] Assignee: Carrier Corporation, Syracuse, N.Y.

[21] Appl. No.: 94,289

[22] Filed: Jul. 21, 1993

[51] Int. Cl.[5] ..... F04B 21/00

[52] U.S. Cl. ..... 417/313; 418/89; 210/136; 210/416.5

[58] Field of Search ..... 417/313; 137/549; 418/89; 210/136, 416.5; 184/6.16, 6.18

[56] References Cited

U.S. PATENT DOCUMENTS

| | | | |
|---|---|---|---|
| 1,616,913 | 2/1927 | McCallum | 418/89 |
| 1,847,068 | 3/1932 | Campbell | 137/549 |
| 1,927,582 | 9/1933 | Denk | 137/549 |
| 1,928,300 | 9/1933 | Peltier | 418/89 |
| 2,289,441 | 3/1940 | Valley et al. | 418/89 |
| 2,750,047 | 6/1956 | Hasbrouck | 210/136 |
| 3,400,821 | 9/1968 | Singleton | 210/136 |
| 3,618,708 | 11/1971 | Deines | 184/6.16 |
| 4,459,208 | 7/1984 | Lemon | 210/416.5 |
| 4,780,061 | 10/1988 | Butterworth | 418/89 |

FOREIGN PATENT DOCUMENTS

| | | | |
|---|---|---|---|
| 58986 | 3/1986 | Japan | 417/313 |
| 4179892 | 6/1992 | Japan | 418/89 |

*Primary Examiner*—Richard A. Bertsch
*Assistant Examiner*—Roland G. McAndrews, Jr.

[57] ABSTRACT

The filter of a compressor is located in the casing of the compressor. The fluid path includes passages in the casing such that brazed connections are not required between the filter and the parts requiring lubrication.

1 Claim, 2 Drawing Sheets

COMPRESSOR WITH INTEGRAL FILTER

BACKGROUND OF THE INVENTION

In refrigeration compressors the affinity between refrigerant and lubricant generally requires separation of oil from the discharged refrigerant and its return to the compressor. Additionally, the returned oil is normally filtered before being supplied to the oil distribution structure. Because the filter must be accessible for replacement as well as isolatable to minimize oil loss, it is located external to the compressor. This, however, requires brazed lines downstream of the filter and this can result in debris being carried to the bearings, etc.

SUMMARY OF THE INVENTION

A filter housing is part of the compressor casing allowing for a single oil entry location to the compressor. The filter is sealed to a check valve assembly. The check valve assembly prevents back flow when the filter is being changed. A solenoid valve is located downstream of the check valve but upstream of the bearings and running gear of the compressor which require lubrication. Accordingly, the solenoid must be opened to permit supplying lubricant.

It is an object of this invention to supply proper filtration of oil as close as possible to the compressor wear surfaces.

It is another object of this invention to eliminate brazing downstream of the filter. These objects, and others as will become apparent hereinafter, are accomplished by the present invention Basically, a filter is located within the compressor casing such that passages in the casing can form at least part of the lubrication supply path which serially includes a filter, a check valve and a solenoid valve.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
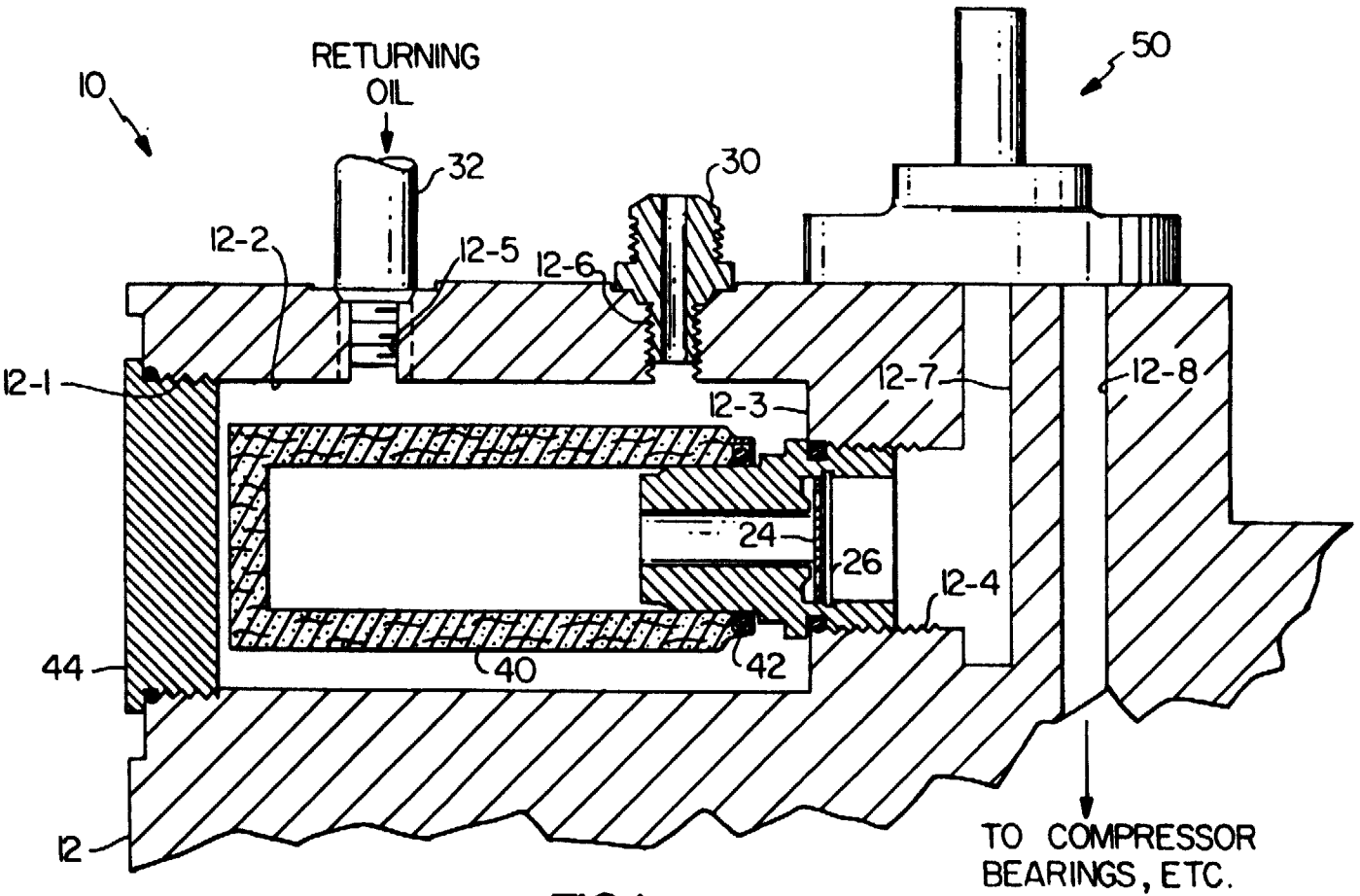
FIG. 1 is a sectional view of a portion of a compressor employing the present invention.

In FIG. 1, the numeral 10 generally designates a compressor having a casing 12. An opening is formed in casing 12 and serially includes threaded portion 12-1, bore 12-2, shoulder 12-3 and threaded bore 12-4. Threaded bores 12-5 and 12-6 communicate with bore 12-2. Bore 12-7 communicates with bore 12-4 and bore 12-8 communicates with the compressor's bearings, running gear, etc.

Figure 2:
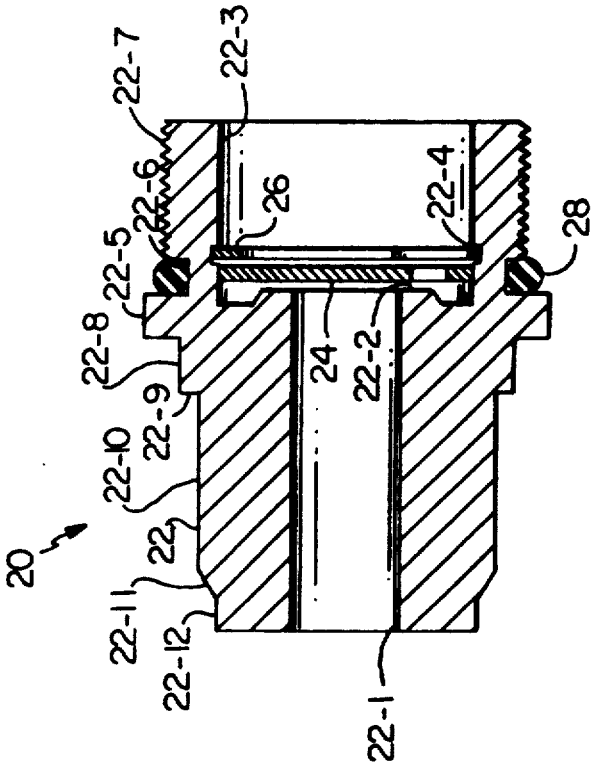
FIG. 2 is a sectional view of the check valve assembly.

As best shown in FIG. 2, check valve assembly 20 includes a body 22. Body 22 has bores 22-1 and 22-3 with valve seat 22-2 therebetween. Annular recess 22-4 is formed in bore 22-3. Body 22 is divided by annular flange portion 22-5. One portion of body 22 has an annular groove 22-6 and a threaded portion 22-7. The other portion of body 22 serially includes hexagonal portion 22-8, shoulder 22-9, cylindrical portion 22-10, transition portion 22-11 and cylindrical portion 22-12.

Figure 4:
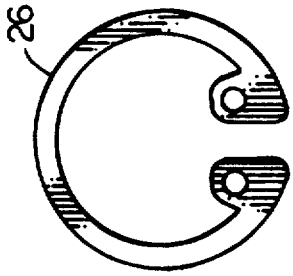
FIG. 4 is a view of the snap ring.
Figure 3:
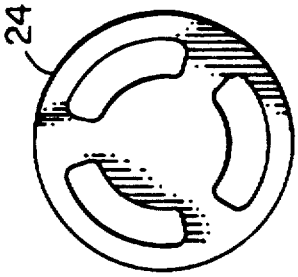
FIG. 3 is a view of the valve member.

Valve member 24 is located in bore 22-3 and is held in place by snap ring 26. Valve member 24 is light and can move between seat 22-2 and snap ring 26 responsive to flow/pressure differential. As best shown in FIG. 3, valve member 24 is made up of a central disk and an annular ring with a plurality of circumferentially spaced webs connecting the central disk and annular ring. As best shown in FIG. 4, snap ring 26 is essentially C-shaped.

In assembling the present invention, valve 24 and snap ring 26 will be in place in valve assembly 20. O-ring or other suitable seal 28 will be located in groove 22-6. Check valve assembly 20 is then installed in casing 12 by threading threaded portion 22-7 into threaded bore 12-4 until a sufficient torque level is obtained after flange 22-5 engages shoulder 12-3. Schrader plug 30 is threaded into bore 12-6 and acts as a bleed. Oil return line 32 is threadably connected to bore 12-5. Filter 40 which carries O-ring or other suitable seal 42 in placed over cylindrical portion 22-12 of body 22 and forced onto cylindrical portion 22-10. Plug 44 is threaded into threaded portion 12-1 such that filter 40 cannot move off of valve assembly 20 while plug 44 is in place.

In operation, oil is returned to compressor 10 from the refrigeration system, at system pressure, via return line 32 and enters bore 12-2. The oil serially passes through filter 40, bore 22-1, check valve 24, bore 22-3, and bore 12-4 into bore 12-7. Assuming that solenoid valve 50 is open, the oil passes from bore 12-7 through the solenoid valve 50 into bore 12-8 from which the oil flows to the compressor bearings, running gear etc. It will be noted that filter 40 is not separated from the parts requiring lubrication by a large distance or by structure requiring brazed connections.

To replace filter 40, compressor 10 will be stopped and solenoid 50 will be closed. Bore 12-2 will be bled through bore 12-6 until the pressure drops to ambient by depressing the valve in the plug 30. Plug 44 will be unthreaded and removed. Any tendency for flow from bores 12-7 and 22-3 will cause valve 24 to seat on valve seat 22-2 and this would be true if solenoid valve 50 failed or leaked. Filter 40 can then be removed and replaced. If necessary, or desired, valve assembly 20 can also be removed and replaced. Plug 44 will then be threaded back into threaded bore 12-1 and plug 30 will be tightened. A vacuum will be pulled via plug 30 and passage 12-6 and then compressor 12 will be started.

Although a preferred embodiment of the present invention has been illustrated and described, other modifications will occur to those skilled in the art. It is therefore intended that the present invention is to be limited only by the scope of the appended claims.

What is claimed is:

1. Compressor means comprising:

casing means;

a first bore in said casing means and having a first and a second end;

means for fluidly sealing said first end of said first bore;

a second bore in said casing means having a first end and a second end;

a check valve assembly secured in said second bore and permitting flow from said first bore to said second bore;

filter means located in said first bore and sealingly connected to said check valve assembly;

a return line connected to said first bore means whereby oil returning via said return line enters said first bore and passes through a flow path serially including said filter means, said check valve assembly, said second bore, third bore in said casing means, solenoid valve means and a fourth bore in said casing means wherein said solenoid valve means selectively permits flow through said flow path from said third bore to said fourth bore for providing lubrication to said compressor means while said check valve assembly prevents flow from said second bore to said first bore.

* * * * *